United States Patent [19]

Hein et al.

[11] Patent Number: 4,595,874

[45] Date of Patent: Jun. 17, 1986

[54] TEMPERATURE INSENSITIVE CMOS PRECISION CURRENT SOURCE

[75] Inventors: Jerrell P. Hein, Longswamp Township, Berks County; Navdeep S. Sooch, Emmaus, both of Pa.

[73] Assignee: AT&T Bell Laboratories, Murray Hill, N.J.

[21] Appl. No.: 654,411

[22] Filed: Sep. 26, 1984

[51] Int. Cl.[4] ..... G05F 3/16

[52] U.S. Cl. ..... 323/312; 323/313; 323/907

[58] Field of Search ..... 323/273, 312–314, 323/907

[56] References Cited

U.S. PATENT DOCUMENTS

| | | | |
|---|---|---|---|
| 3,813,595 | 5/1974 | Sheng | 323/312 |
| 3,984,780 | 10/1976 | Hsiao et al. | 330/253 |
| 4,158,804 | 6/1979 | Butler et al. | 323/281 |
| 4,208,639 | 6/1980 | Stickel | 331/116 FE |
| 4,317,054 | 2/1982 | Caruso et al. | 307/297 |
| 4,327,320 | 4/1982 | Oguey et al. | 323/313 |
| 4,346,344 | 8/1982 | Blauschild | 323/313 |
| 4,347,476 | 8/1982 | Tam | 323/313 |

FOREIGN PATENT DOCUMENTS

| | | | |
|---|---|---|---|
| 136649 | 11/1978 | Japan | 323/313 |
| 514280 | 6/1976 | U.S.S.R. | 323/907 |

OTHER PUBLICATIONS

"A Highly Stable Current . . . ", *Journal of Physics E: Scientific Instruments,* May 1972, L. E. MacHattie, pp. 1016–1017.

*Primary Examiner*—William H. Beha, Jr.
*Attorney, Agent, or Firm*—Wendy W. Koba

[57] ABSTRACT

A CMOS precision current source which is insensitive to changes in both ambient temperature and processing conditions. In particular, a CMOS circuit exhibits both a temperature dependent voltage (V(T)) and a temperature dependent on-chip resistance (R(T)) where the dependencies of both voltage and resistance are linear functions of temperature of the form $y=mx+b$. The ratio of the slopes ($m_V/m_R$) is constructed to be equal to the ratio of the y-intercepts ($b_v/b_R$), where this ratio is a constant value, denoted s. Therefore, since a constant output current $I_o$ is equal to V(T)/R(T), $I_o$ will be equal to the constant value s. Additionally, a constant reference voltage ($V_o$) may also be provided with a minimal increase in the circuitry needed to provide the constant current.

7 Claims, 4 Drawing Figures

TEMPERATURE INSENSITIVE CMOS PRECISION CURRENT SOURCE

BACKGROUND OF THE INVENTION

1. Field of the Invention

The present invention relates to a CMOS precision current source and, more particularly, to a temperature insensitive CMOS precision current source which varies only with sheet resistance and is insensitive to other process parameters.

2. Description of the Prior Art

Many parameters of analog circuits, such as slew rate and operational amplifier gain, are a strong function of bias current. Therefore, it is important to bias analog circuits with a precision temperature independent current source. One early attempt to provide such a current source is disclosed in U.S. Pat. No. 3,813,595 issued to A. C. N. Sheng on May 28, 1974. In this arrangement, an MOS transistor which has its gate electrode connected to its drain electrode is utilized as a constant current device by means of a resistive network placed between its source and substrate electrodes. A remaining problem with this circuit, however, is that the output current is still a function of the circuit bias voltage, which will drift with changes in temperature.

Circuits which provide a constant reference voltage are also difficult to design, for many of the same reasons. One prior art arrangement for providing a temperature independent voltage reference is disclosed in U.S. Pat. No. 4,158,804 issued to W. J. Butler et al on June 19, 1979. In the Butler et al arrangement, the reference voltage circuit consists of a series-connected long channel MOS transistor and short channel MOS transistor which produce, at their junction, a temperature independent voltage. A differential circuit containing three MOS transistors is then provided with one of the transistors serving as a current source that carries the current to the other two MOS transistors which are in parallel. The gates of the two parallel MOS transistors are connected between the above-defined junction and the output. Current divides between the two parallel MOS transistors in such a way as to cause a constant output voltage to be produced regardless of supply variations. This circuit, however, remains sensitive to processing variations.

An article entitled "A Highly Stable Current or Voltage Source", by L. E. MacHattie appearing in *Journal of Physics E: Scientific Instruments,* Vol. 5, 1972, at pp. 1016–7, describes an arrangement which may serve as either a current or voltage source. As described, a chain of FETs is utilized, where a zero temperature coefficient is obtained at a certain current value characteristic of the individual transistor. However, the dynamic operating range of this arrangement is rather limited.

SUMMARY OF THE INVENTION

The present invention relates to a CMOS precision current source and, more particularly, to a temperature insensitive CMOS precision current source which provides an output current that varies only with sheet resistance and is insensitive to other process parameters.

It is an aspect of the present invention to provide a CMOS circuit which forces both the voltage V(T) and on-chip resistance R(T) to exhibit the same temperature dependency. That is, $I_o = V(T)/R(T) = \text{constant}$, where $I_o$ is defined as the desired constant output current.

Another aspect of the present invention is to provide, at a minimal increase in circuitry, a high quality voltage reference which is likewise insensitive to changes in ambient temperature.

Yet another aspect of the present invention is to provide a precision source which is completely self-contained, requiring no external voltage or current sources.

Other and further aspects of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

As previously stated, many analog systems require a current source to bias their circuits in the linear region. It is known that many circuit parameters, such as slew rate and transconductance, are a function of the bias current and, therefore, circuits require a precision current source to reduce variations in performance over processing and temperature fluctuations. Additionally, a precision reference voltage is often required, where the current source and voltage reference are often realized as two separate circuits. As will be explained in greater detail hereinafter, the precision current source formed in accordance with the present invention provides a temperature insensitive current source which approaches the minimum attainable process sensitivity for a fully integratable design, and is also capable of providing a precise voltage reference with a minimum of additional components.

The present invention provides a precision current source that will not vary with temperature by forcing the on-chip circuit voltage to vary with temperature in the same manner as the on-chip resistance. That is, $V(T)/R(T) = \text{constant}$, where V(T) is defined as the temperature dependent circuit voltage and R(T) is defined as the temperature dependent on-chip resistance. Therefore, in accordance with the present invention, $$I_o = V(T)/R(T) = \text{constant}, \tag{1}$$

where $I_o$ is defined as the constant current output from the precision current source.

It is well known that on-chip resistors exhibit a temperature dependency of the form $$R(T) = R_o\left[1 + \frac{A}{10^6}(T - T_o)\right] \tag{2}$$

-continued $$= \left(R_o \frac{A}{10^6}\right) T + \left(R_o - \frac{T_o A R_o}{10^6}\right),$$

where $T_o$ is defined as the reference temperature, $R_o$ is defined as the value of R(T) at temperature $T_o$, and A, is defined as the temperature coefficient in parts per million. Equation (2) which defines R(T), is of the familiar $y=mx+b$ form, which is known to represent a linear function. In particular, $$m_R = \frac{R_o A}{10^6}, \text{ and} \tag{3}$$

$$b_R = R_o - \frac{T_o A R_o}{10^6} \tag{4}$$

where $m_R$ is defined as the slope of the function R(T) and $b_R$ is defined as the y-intercept of the function R(T). In accordance with the present inention, therefore, V(T) must also be of the $y=mx+b$ form, where in association with equation (1), $$\frac{m_V}{m_R} = \frac{b_V}{b_R} = \text{constant}, \tag{5}$$

where $m_V$ is defined as the slope of V(T) and $b_V$ is defined as the y-intercept of V(T). Therefore, a current source formed in accordance with the present invention is designed to provide the values of $m_v$ and $b_v$ required for equation (5) to be valid. It is to be noted that $R_o$, the value of R(T) at $T_o$, is a process dependent parameter, known to vary ±15%, and variations of $R_o$ define the minimum attainable process sensitivity for a precision current source formed in accordance with the present invention.

Figure 1:
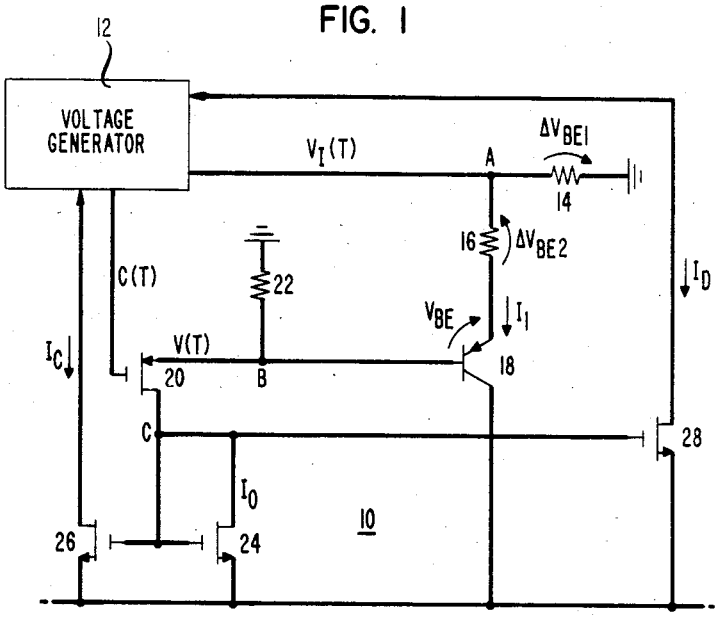
FIG. 1 illustrates an exemplary CMOS precision current source formed in accordance with the present invention.
Figure 2:
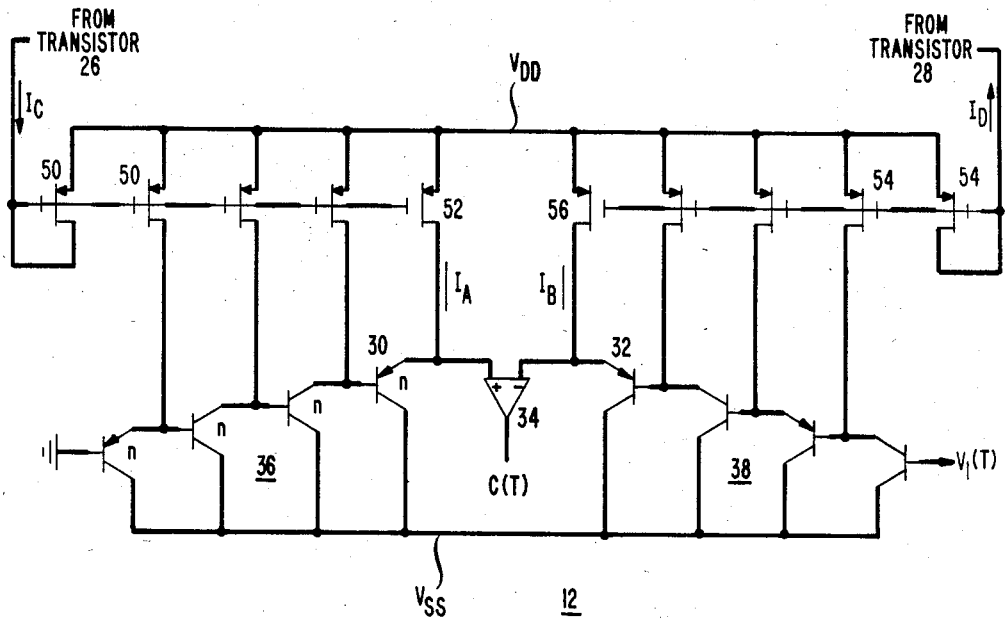
FIG. 2 contains a detailed illustration of a portion of the circuit of FIG. 1 which comprises a temperature dependent voltage source.

FIG. 1 illustrates an exemplary precision current source 10 formed in accordance with the present invention, utilizing the information associated with equations (1)–(5). Additionally, a large $\Delta V_{BE1}$ is utilized to reduce amplifier offset errors that prior art arrangements are known to exhibit. As will be explained in detail hereinafter, all of the analog computations needed to form V(T) are performed in one feedback loop, thus eliminating any current mirroring errors which would otherwise exist. Referring now to FIG. 1, a voltage generator 12 is included in current source 10, where the output of voltage generator 12, denoted $V_1(T)$, is a known function of temperature. An exemplary voltage generator 12 which may be utilized in association with the present invention is illustrated in FIG. 2, and will be discussed in detail hereinafter. Voltage $V_1(T)$ is applied as an input at the junction of a resistor divider network, defined as node A, formed by a first resistor 14 and a second resistor 16, where resistor 14 is connected between node A and ground. Resistor 16, as seen in FIG. 1, is connected between node A and the emitter of a PNP transistor 18. The voltage drop across resistor 14 is defined as $\Delta V_{BE1}$ and the voltage drop across resistor 16 is defined as $\Delta V_{BE2}$.

In accordance with the present invention, the base of PNP transistor 18 is connected to the source of a P-channel MOS transistor 20, where the interconnection is defined as node B. A resistor 22 is connected between node B and ground. As seen in FIG. 1, the gate of MOS transistor 20 is activated by a reference signal, denoted C(T), generated by voltage generator 12. Control signal C(T) functions to adjust the gate voltage in order to have the voltage drop required across resistor 22 to provide the desired constant output current $I_o$. As seen in FIG. 1, output current $I_o$ is the drain current associated with MOS transistor 20.

Output current $I_o$ flows through MOS transistor 20 and subsequently appears at the drain of an N-channel MOS transistor 24, defined at node C. Transistor 24 is utilized as an output device and also provides a feedback signal to voltage generator 12. In particular, MOS transistor 24 is connected to a pair of N-channel MOS transistors 26 and 28 as shown in FIG. 1, where the sources of transistors 24, 26, and 28 are connected to VSS and the drains of transistors 26 and 28 are connected to voltage generator 12. Therefore, the gate-to-source voltage ($V_{GS}$) of transistor 24 will activate the gates of transistors 26 and 28 to in turn provide an activating signal which is fed back to voltage generator 12. Thus, as stated above, a constant output current $I_o$ is provided by a circuit which contains only one feedback loop.

Since V(T) is defined as the voltage drop between node B and ground, $$I_o = \frac{\left[\frac{\Delta V_{BE2}(T_o)}{T_o}\right] T + V_{ref}}{R(T)}, \tag{6}$$

where $\Delta V_{BE2}(T_o)$ is defined as the value of $\Delta V_{BE2}$ at the temperature $T_o$, $V_{ref}$ is defined as $\Delta V_{BE1}+V_{BE}$, and R(T) is determined for resistor 22. Therefore, in association with equations (1) and (6), $$V(T) = \left|\frac{\Delta V_{BE2}(T_o)}{T_o}\right| T + V_{ref}. \tag{7}$$

Applying the $y=mx+b$ relation, $$b_v = V_{ref}, \text{ and} \tag{8}$$

$$m_V = \left[\frac{\Delta V_{BE2}(T_o)}{T_o}\right] \tag{9}$$

Further, for a given process, as stated above, both $V_{ref}$ and A (defined above as the temperature coefficient of the on-chip resistance) are fixed values. Therefore, only the quantity $\Delta V_{BE2}$ need be determined to provide the desired constant output current $I_o$. The value of $\Delta V_{BE2}$ needed is found by applying equation (5), which may be rewritten as follows:

$$m_v = \frac{b_v m_R}{b_R}. \tag{10}$$

Substituting equations (3), (4), (8), and (9) into equation (10) yields $$\frac{\Delta V_{BE2}(T_o)}{T_o} = \frac{V_{ref} \cdot \frac{R_o A}{10^6}}{R_o - \frac{T_o A R_o}{10^6}} \tag{11}$$

where simplifying and solving for $\Delta V_{BE2}$ yields $$\Delta V_{BE2(T_O)} = \frac{V_{ref} \cdot A \cdot T_o}{(10^6 - T_o a)} \quad (12)$$

Therefore, since the equation for V(T) can be solved completely, and the desired constant output current $I_o$ is known, the value of resistor 22 needed to provide $I_o$ can be found simply by solving $$R(T) = V(T)/I_o.$$

In other words, the quantity $R_o$, which is defined as the value of resistor 22 at the reference temperature, will dictate the magnitude of output current $I_o$.

FIG. 2 illustrates in detail an exemplary voltage generator 12 which may be utilized in accordance with the present invention to supply an output voltage which is proportional to temperature and, in particular, exhibits a positive temperature coefficient. To explain the operation of voltage generator 12 in general, reference is made to a first PNP transistor 30 and a second PNP transistor 32 interconnected as shown in FIG. 2, where the emitter of transistor 30 is n times larger than the emitter of transistor 32. Transistor 30, as shown in FIG. 2, is also connected in series with a plurality of base-emitter connected transistors, each of which comprises an emitter region n times larger than that of transistor 32. Similarly, transistor 32 is connected in series with a plurality of base-emitter connected transistors, all comprising the same size emitter region as transistor 32. Also, MOS transistors 26, 50, and 52 are scaled to size with respect to transistors 28, 54, and 56 such that the current $I_a$ flowing through transistor 52 is m times smaller than $I_b$, the current through transistor 56, or $$I_a = \frac{I_b}{m}. \quad (13)$$

It is well known that the base-to-emitter voltage of a PNP transistor is defined by the following relation:

$$|V_{BE}| = V_T \left| \ln \frac{I_c}{I_s} \right| \quad (14)$$

where $V_T$ is equal to the well-known relation kT/q. Therefore, $$|V_{BEa}| = V_T \left| \ln \frac{I_{ca}}{I_{sa}} \right|, \text{ and} \quad (15)$$

$$|V_{BEb}| = V_T \left| \ln \frac{I_{Cb}}{I_{Sb}} \right|, \quad (16)$$

where $V_{BEa}$ defines the base-to-emitter voltage associated with transistor 30 and $V_{BEb}$ defines the base-to-emitter voltage associated with transistor 32. Ignoring the remaining transistor structure for the moment, the signal $V_1(T)$, which is applied to node A of the structure illustrated in FIG. 1, is equal to $V_{BEa} - V_{BEb}$, which may be expressed as $$V_1(T) = |V_{BEa}| - |V_{BEb}| \quad (17)$$

-continued $$= V_T \left( \left| \ln \frac{I_{ca}}{I_{sa}} \right| - \left| \ln \frac{I_{cb}}{I_{sb}} \right| \right).$$

Simplifying this equation utilizing the relation of equation (13) yields $$V_1(T) = -V_T \ln (m \cdot n). \quad (18)$$

Stacking the plurality of PNP transistors as shown in FIG. 2 simply multiplies the value of $V_1(T)$ in equation (18) by 4, without amplifying the offset error of operational amplifier 34.

As stated above, control signal C(T) adjusts the gate voltage of MOS transistor 20 to provide the correct voltage drop across resistor 22. Referring to FIG. 2, signal C(T) is provided by the output of operational amplifier 34. The high gain of amplifier 34 forces the emitter voltages of transistors 30 and 32 to be equal (if amplifier 34 has no offset) by controlling C(T). This feedback action allows equation (17) to be valid.

Figure 3:
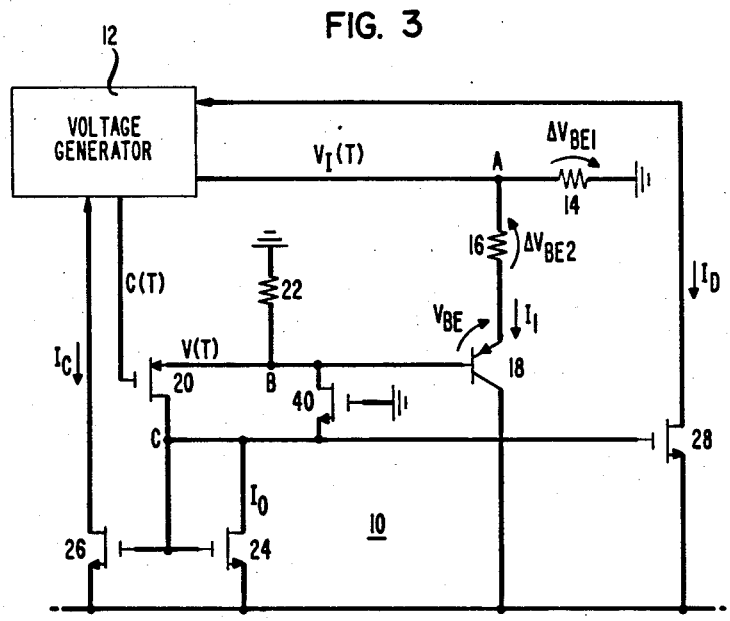
FIG. 3 illustrates an alternative embodiment of a CMOS precision current source formed in accordance with the present invention which guarantees "start-up", the presence of the desired reference current output after the power supplies are activated.

Since the circuit of the present invention is completely self-contained, a problem may exist if there is no voltage V(T) present when the circuit is first connected. Given that situation, no current $I_C$ and $I_D$ would be fed back to voltage generator 12, the pluralities of MOS transistors 36 and 38 would not be turned on, and both output voltage $V_1(T)$ and control signal C(T) could remain equal to zero. Therefore, to protect against this situation, an additional MOS transistor 40, disposed as shown in FIG. 3, may be utilized to guarantee the presence of a nonzero V(T) under any operating circumstances. As seen by reference to FIG. 3, the drain of transistor 40 is connected to node B and the source of transistor 40 is connected to node C, where the gate of transistor 40 is connected to ground. Since the gate of transistor 40 is grounded, transistor 40 will always be conducting some current and some voltage V(T) will always be present, thus allowing the circuit to "start-up", since only the slightest voltage V(T) is needed to initiate the circuit.

Figure 4:
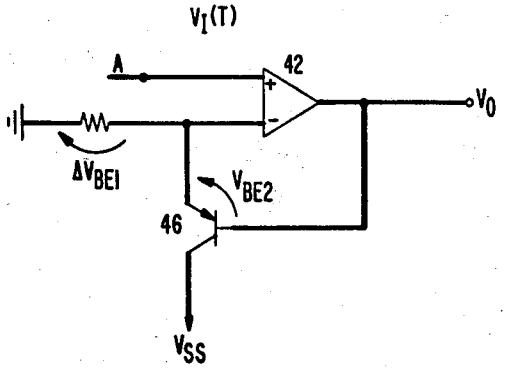
FIG. 4 illustrates an exemplary CMOS reference voltage circuit formed in accordance with the present invention.

As previously stated, the present invention may also be utilized to provide a precise voltage reference by incorporating a few additional devices into the circuit illustrated in FIG. 1. In particular, FIG. 4 illustrates the additional circuitry required to form a voltage reference circuit in accordance with the present invention. As shown, the reference voltage $V_1(T)$, which as defined above is a function of absolute temperature, is applied as the positive input to an operational amplifier 42. The node A is also contained in FIG. 4 to illustrate the point of interconnection between the circuitry of FIG. 4 and the circuitry of FIG. 1. A resistor 44 is connected between the negative input terminal of operational amplifier 42 and ground, where the value of resistor 44 is equal to the value of resistor 14 of currnt source 10. Therefore, the same $\Delta V_{BE1}$, will appear across resistor 44 as appears across resistor 14. As seen in FIG. 4, the emitter of a PNP transistor 46 is also connected to the negative input of operational amplifier 42, where the collector of transistor 46 is connected to the VSS power supply and the base of transistor 46 is connected to the output of operational amplifier 42. Transistor 46 is chosen in accordance with the present invention to exhibit a $V_{BE2}$ equal to $V_{BE1}$ of transistor 18 included in current source 10. Therefore, a bandgap voltage reference, defined as $V_o$, will be formed by the addition of $\Delta V_{BE1}$ and $V_{BE2}$, where the presence of $V_1(T)$ will allow $V_o$ to remain constant in the presence of changing temperature conditions.

What is claimed is:

1. A CMOS circuit (10) for providing a constant current ($I_o$) output, said CMOS circuit comprising means for generating a temperature dependent voltage (V(T) wherein the temperature dependency is linear of the form $y=m_v x+b_v$, $m_v$ being defined as a voltage temperature coefficient and $b_v$ being defined as a reference voltage ($V_{ref}$);

a temperature dependent on-chip resistance (R(T)) wherein the associated temperature dependency is of the form $y=m_v x+b_v$, $m_v$ being defined as a voltage temperature coefficient and $b_v$ being defined as a reference voltage ($V_{ref}$);

a temperature dependent on-chip resistance (R(T)) wherein the associated temperature dependency is of the form $y=m_R x+b_R$, $m_R$ being defined as an on-chip resistance temperature coefficient and $b_R$ being defined as a reference value ($R_o$) of said on-chip resistance at a predetermined reference temperature ($T_o$), said temperature dependent voltage means and said temperature dependent on-chip resistance being related such that $m_R/m_V=b_R/b_v=$constant; and output means (20) responsive to both said temperature dependent voltage means and said temperature dependent on-chip resistance for providing said constant current as an output of said CMOS circuit where said constant current is equal to the value of said temperature dependent voltage means divided by the value of said on-chip resistance.

2. A CMOS circuit as defined in claim 1 wherein the voltage generating means comprises a voltage source (12) for providing both an input voltage ($V_1(T)$) which exhibits a positive increase in magnitude for positive increases in temperature and a control signal (C(T)) whose magnitude varies in a positive direction for positive increases in temperature;

a bipolar junction transistor (18) which includes a base electrode, a collector electrode, and an emitter electrode, wherein said collector electrode is connected to a negative power supply (VSS); and a resistor divider network comprising a first (14) and a second (16) resistor connected between said emitter electrode of said bipolar junction transistor and ground, said input voltage ($V_1(T)$) being applied at the interconnection of said first and second resistors to provide a first voltage $\Delta V_{BE1}$ across said first resistor and a second voltage $\Delta V_{BE2}$ across said second resistor, said first and second voltages thus generating the temperature dependent voltage (V(T)) between said base electrode of said bipolar transistor and ground, said temperature dependent voltage being defined as $V(T)=(\Delta V_{BE2}(T_o)/T_o)T+V_{ref}$, where $\Delta V_{BE2}(T_o)$ is defined as the value of said second voltage at the predetermined temperature and $V_{ref}$ is defined as the sum of said first voltage ($\Delta V_{BE1}$) and said bipolar junction transistor base-to-emitter voltage.

3. A CMOS circuit as defined in claim 2 wherein the temperature dependent on-chip resistance comprises a resistor (22) connected between the base electrode of the bipolar junction transistor and ground which exhibits a temperature dependency of the form $R(T)=(R_oA/10^6)T+(R_o-(T_oAR_o/10^6))$, where $R_o$ is defined as the value of said resistor at the predetermined reference temperature ($T_o$) and A is defined as a predetermined temperature coefficient defined in parts per million.

4. A CMOS circuit as defined in claim 2 wherein the output means comprises an MOS transistor including a source electrode, a gate electrode, and a drain electrode, wherein said source electrode is connected to both the on-chip resistance and the base electrode of the first bipolar junction transistor, said gate electrode being activated by the control signal generated by the voltage source of the voltage generating means for monitoring the voltage drop across said on-chip resistance, said MOS transistor thus providing the constant current output at said drain electrode.

5. A CMOS circuit as defined in claim 2 wherein said CMOS circuit further comprises activation means (40) disposed in parallel with the output means for providing a voltage drop across said output means when the input voltage of the voltage generating means is equal to zero.

6. A CMOS circuit as defined in claims 5 wherein the activation means comprises an MOS transistor including a source electrode, a gate electrode, and a drain electrode, wherein the drain electrode is connected to the base of the first bipolar junction transistor, the gate electrode is connected to ground, and the source electrode is connected to the output of said output means.

7. A CMOS circuit as defined in claim 2 wherein the circuit further comprises means for providing a constant reference voltage ($V_o$) output, said means including differential amplifying means including a positive and a negative input terminal and an output terminal for providing an output signal equal to the amplified difference between a pair of signals applied to said positive and negative input terminals, said differential amplifying means responsive at said positive input terminal to the input voltage ($V_1(T)$) produced by the voltage source of the voltage generating means;

an on-chip resistance connected between ground and said negative input terminal; and a bipolar junction transistor including a base electrode, an emitter electrode, and a collector electrode, said bipolar junction transistor exhibiting a base-to-emitter voltage VBE equal to the base-to-emitter voltage of the voltage generating means bipolar junction transistor, wherein the emitter of said bipolar junction transistor is connected to said negative input terminal, the collector is connected to ground, and the base of said bipolar junction transistor is connected to said output terminal of said differential amplifying means to provide as an output signal of said differential amplifying means the constant reference voltage.

* * * * *

UNITED STATES PATENT AND TRADEMARK OFFICE

CERTIFICATE OF CORRECTION

PATENT NO. : 4,595,874

DATED : June 17, 1986

INVENTOR(S) : Jerrell P. Hein, Navdeep S. Sooch

It is certified that error appears in the above-identified patent and that said Letters Patent is hereby corrected as shown below:

Column 7, delete lines 14 through and including line 18, which reads as follows:

> a temperature dependent on-chip resistance (R(T)) wherein the associated temperature dependency is of the form $y=m_v x+b_v m_v$ being defined as a voltage temperature coefficient and $b_v$ being defined as a reference voltage ($V_{ref}$);

Signed and Sealed this

Sixth Day of January, 1987

*Attest:*

*Attesting Officer*

DONALD J. QUIGG

*Commissioner of Patents and Trademarks*